US007359286B2

(12) United States Patent
Stuart Savoia et al.

(10) Patent No.: US 7,359,286 B2
(45) Date of Patent: Apr. 15, 2008

(54) MULTI-LEVEL CAPACITIVE ULTRASONIC TRANSDUCER

(75) Inventors: Alessandro Stuart Savoia, Rome (IT); Giosuè Caliano, Rome (IT); Alessandro Caronti, Rome (IT); Cristina Longo, Pietramontecorvino (IT); Massimo Pappalardo, Rome (IT)

(73) Assignee: Esaote S.p.A., Milan (IT)

( * ) Notice: Subject to any disclaimer, the term of this patent is extended or adjusted under 35 U.S.C. 154(b) by 0 days.

(21) Appl. No.: 11/743,371

(22) Filed: May 2, 2007

(65) Prior Publication Data

US 2007/0258332 A1 Nov. 8, 2007

(30) Foreign Application Priority Data

May 3, 2006 (IT) ..... RM2006A0238

(51) Int. Cl.
*H04R 19/00* (2006.01)

(52) U.S. Cl. ..... 367/181

(58) Field of Classification Search ..... 367/181
See application file for complete search history.

(56) References Cited

U.S. PATENT DOCUMENTS 4,370,785 A * 2/1983 Assenza et al. ..... 29/25.35
4,409,510 A * 10/1983 Assenza et al. ..... 310/334
6,632,178 B1 * 10/2003 Fraser ..... 367/181
6,798,118 B1 * 9/2004 Wen ..... 310/323.02
7,074,634 B2 * 7/2006 Foglietti et al. ..... 438/50
2004/0180466 A1 * 9/2004 Foglietti et al. ..... 438/53
2005/0018536 A1 * 1/2005 Caliano et al. ..... 367/7
2005/0206479 A1 * 9/2005 Nguyen et al. ..... 333/186
2006/0007045 A1 * 1/2006 Fiasca et al. ..... 343/700 MS
2007/0059858 A1 * 3/2007 Caronti et al. ..... 438/50
2007/0097791 A1 * 5/2007 Chang et al. ..... 367/181

FOREIGN PATENT DOCUMENTS

EP 582557 A2 * 2/1994
EP 1493499 A2 * 1/2005
EP 1764162 A1 * 3/2007
WO WO02/091796 * 11/2002
WO WO 2006092820 A2 * 9/2006

* cited by examiner

*Primary Examiner*—Dan Pihulic
(74) *Attorney, Agent, or Firm*—Roberts Mlotkowski & Hobbes PC

(57) ABSTRACT

The invention concerns a capacitive ultrasonic transducer, comprising an external layer operating as an external plate, provided with electrode means, capable to vibrate, and a stiff substrate, in turn provided with electrode means, wherein it further comprises n levels, with n≧2, interposed between the plate and the substrate, each level including a plurality of cavities, and m interface intermediate layers, capable to vibrate, among said n levels, with m=(n−1), the cavities of each one of said n levels being further defined by support means connected between faced surfaces of layers adjacent to said cavities, each one of said m intermediate layers being provided with electrode means, whereby the cavities of each level are interposed between a pair of electrode means belonging to either two adjacent intermediate layers or to an intermediate layer and to one out of the substrate and the plate.

13 Claims, 10 Drawing Sheets

MULTI-LEVEL CAPACITIVE ULTRASONIC TRANSDUCER

CROSS REFERENCE TO RELATED APPLICATIONS

The present Application claims priority from Italian Application No. RM2006A000238 filed on May 3, 2006, which is hereby incorporated by reference in its entirety into the present Application.

FIELD OF THE INVENTION

The present invention concerns a multi-level capacitive ultrasonic transducer, in particular a capacitive transducer micromachined on silicon, which allows to obtain high transduction efficiency, high transmitted pressure, and a high electro-mechanical transformation factor, operating over large bandwidths.

BACKGROUND OF THE INVENTION

Presently commercially available echographic systems obtain information from the surrounding means and from human body, using elastic waves at ultrasonic frequency. To this end, the echographic probes generally use capacitive ultrasonic transducers, in particular obtained by means of silicon micromachining, capable to generate and detect ultrasonic waves, through which an ultrasonic imaging process (image generation) is carried out.

Capacitive transducers, constituted of two faced electrode (one of which is fixed and the other is movable) which are spaced apart by a cavity, are based on the electrostatic attraction force that is present whenever a charge amount is accumulated on the same electrodes by applying a potential difference. In order to obtain transduction linearity and efficiency a (biasing) dc voltage is usually applied to which a (signal) ac voltage is added.

In general, transmission transduction efficiency, i.e. the ratio of the transmitted acoustic pressure (proportional to the relative movement between the electrodes) to the applied ac electric voltage, increases with the increase of the biasing dc voltage and of the accumulated charge, i.e. it increases with the increase of the electric field present within the cavity.

In general, the reception transduction efficiency, i.e. the ratio of the transducer output voltage or current to the pressure incident on the transducer surface, also increases with the increase of the biasing dc voltage.

However, the open circuit reception efficiency (i.e. ideal voltage detection) is directly proportional to the biasing voltage and to the relative movement between the electrodes, while the short circuit reception efficiency (i.e. ideal current detection) is directly proportional to the static charge accumulated by means of the biasing voltage (that hence depends on the capacitance) and to the relative speed between the electrodes.

FIG. 1 shows the classical lumped parameter model of an electro-mechanical transducer. For a membrane capacitive transducer (such as a capacitive ultrasonic transducer), the mechanical behaviour may be approximated, in absence of losses and for frequencies close to the natural vibration first mode resonance frequency $f_{ris}$, as the $C_m$-$L_m$ series, where $C_m$ represents the membrane "compliance" and $L_m$ represents the membrane "mass".

These two quantities are proportional to the geometrical parameters (thickness t and side dimensions $l_x$ and $l_y$), and to the properties of the materials of which the membrane is constituted (density ρ and Young modulus $E_x$) according to the following formulas:

$$C_m = \frac{1}{k} \propto E_x \cdot \frac{l_x \cdot l_y}{t} \quad [1]$$

where k is the stiffness constant of the equivalent spring, and $$L_m \propto \rho \cdot l_x \cdot l_y \cdot t \quad [2].$$

Transformation factor ϕ depends on the capacitance value $C_0$ of the transducer to which the only biasing voltage is applied, on the applied dc biasing voltage $V_{DC}$, and on the distance $d_{gap}$ between the electrodes, according to the following formula:

$$\phi = C_0 \frac{V_{DC}}{d_{gap}} \quad [3]$$

The collapse voltage $V_{col}$, representing the maximum limit of biasing dc voltage $V_{DC}$ applicable to the transducer without collapse of the upper electrode on the lower one, is limited by the membrane compliance $C_m$: the more the membrane is stiff, the higher is the applicable dc voltage. In general, the collapse voltage $V_{col}$ is, for flexural capacitive transducers, equal to:

$$V_{col} = \alpha \cdot \sqrt{\frac{d_{gap}^3}{C_m \varepsilon_0}} \quad [4]$$

with α that is constant and depending on how the flexural structure is constrained.

In order to increase the collapse voltage $V_{col}$ it is hence needed to decrease the membrane compliance $C_m$.

The increase of the collapse voltage $V_{col}$ (i.e. of the maximum applicable dc voltage $V_{DC_max}$) entails the increase of the transformation factor ϕ, on which the transmission and reception efficiencies directly depend. The transformation factor is maximum when $V_{DC}=V_{col}$, and it is equal to:

$$\phi_{max} = \alpha \cdot S \cdot \sqrt{\frac{\varepsilon_0}{C_m d_{gap}}} \quad [5]$$

where S is the membrane area.

Thus, in order to increase the transduction efficiencies, it is needed a decrease of the membrane compliance $C_m$ and a decrease of the electrode distance $d_{gap}$.

FIG. 2 shows a sectional view (FIG. 2*a*) and a plan view (FIG. 2*b*) of an ultrasonic capacitive transducer. The vibrating structure is a plate 1 (usually made through a transparent membrane, as shown in FIG. 2*b*), provided with an electrode 15, that is constrained to a stiff substrate 2, in turn provided with an electrode 6, by means of an array of columns 3 arranged in an ordered manner (in the case of FIG. 2 it is a square grid of columns 3). Both electrodes 15 and 6 (represented in FIG. 2*a* with continuous lines), between which cavities 4 are interposed, are protected by a respective film 7 and 8 of insulating material. This film serves for preventing, in case of collapse of the membrane 1 on the substrate 2, the electrodes 15 and 6 from short-circuiting.

For reasons of efficiency, each insulating film 7 and 8 should be as thin as possible. In fact, the space between the two electrodes 15 and 6 is partly occupied by the insulating films 7 and 8. The capacitance between the two electrodes 15 and 6 may be hence seen as series of three capacities, only one of which is variable, thus constituting the active capacitance in the electromechanical operation, while the other two ones are due to the presence of the insulating dielectric material and they do not contribute to transduction (for this reason the series of these two ones is called parasitic series capacitance). The active capacitance is the one that varies under a flexural deformation of the membrane 1 and hence under the variation of the distance $d_{gap}$ between the electrodes 15 and 6. When a potential difference is applied at the ends of this series of capacities, it distributes between the active capacitance and the parasitic series one due to the protection films. Only the voltage across the active capacitance is responsible for the mechanical actuation of the membrane 1. For this reason it is convenient that the insulating material films 7 and 8 are as thin as possible.

Finally, the structure is covered by an insulating material film 9. This structure, also known as MAMMUT, has a natural vibration mode wherein all the cells delimited by four columns 3 vibrating with the same phase. The frequency of this mode (that will be called resonance frequency $f_{ris}$ from now on) is determined by the geometric characteristics (thicknesses of the membrane 1, distance and size of the columns 3) and by the properties of the materials. The vibrational behaviour may, for frequencies close to the resonance frequency $f_{ris}$, be modelled by a lumped-parameter model as a system mass-spring ($C_m$-$L_m$), as previously shown with reference to FIG. 1.

However, conventional ultrasonic transducers suffer from some limitations.

First of all, the transmission efficiency is equal to the ratio of the transmitted pressure to the applied ac voltage. In order to emit a certain pressure, the membrane must be able to vibrate with a sufficient amplitude along the propagation direction. The extent of this movement is connected to the generated pressure (to a first approximation) through the characteristic acoustic impedance $Z_a$ of the fluid, defined as the ratio of the pressure P to the velocity v of the fluid particles for plane wave propagation:

$$Z_a = \frac{P}{v}. \quad [6]$$

Points over the transducer surface will have a velocity v equal to:

$$v = \beta \cdot \frac{P}{Z_a} \quad [7]$$

wherein β is constant (ranging from 0 to some units) and depending on the position of each single point. Movement u if such points is related to velocity and vibration frequency f:

$$u = \frac{v}{2\pi f} \quad [8]$$

Therefore, a decrease of the distance $d_{gap}$ between the electrodes 15 and 6, on the one hand, increases the electrostatic pressure acting on the movable membrane 1, but, on the other hand, limits the maximum amplitude of the membrane movement, and hence the maximum transmitted pressure P.

Moreover, the flexural capacitive transducers are usually used in applications wherein a large bandwidth is required. This is obtained by designing the flexural structures so that their mechanical impedance $Z_m$ have module lower than or comparable to the acoustic impedance $Z_a$ of the fluid wherein it is desired to generate acoustic waves for an extended frequency range (approximately the one of the transmission band at −6 dB).

Therefore, since the mechanical impedance of a flexural structure is equal to:

$$Z_m = j\omega L_m + \frac{1}{j\omega C_m}, \quad [9]$$

by decreasing the structure compliance $C_m$, the module of the mechanical impedance $Z_m$ increases with a consequent reduction of the bandwidth. In other words, a decrease of the flexural structure compliance $C_m$ increases the electro-mechanical transformation factor ϕ, and hence the transmission and reception transduction efficiency, to the detriment of the transducer bandwidth.

SUMMARY OF THE INVENTION

It is therefore an object of the present invention to provide a multi-level capacitive ultrasonic transducer, in particular a capacitive transducer micromachined on silicon, which allows to obtain high transduction efficiencies, high transmitted pressure, and a high electro-mechanical transformation factor, operating over large bandwidths.

It is specific subject matter of this invention a capacitive ultrasonic transducer, comprising an external layer operating as an external plate, provided with electrode means, capable to vibrate, and a stiff substrate, in turn provided with electrode means, characterized in that it further comprises n levels, with n≧2, interposed between the plate and the substrate, each level including a plurality of cavities, and m interface intermediate layers, capable to vibrate, among said n levels, with m=(n−1), the cavities of each one of said n levels being further defined by support means connected between faced surfaces of layers adjacent to said cavities, each one of said m intermediate layers being provided with electrode means, whereby the cavities of each level are interposed between a pair of electrode means belonging to either two adjacent intermediate layers or to an intermediate layer and to one out of the substrate and the plate.

Always according to the invention, said electrode means of each one of said m intermediate layers may comprise one or more metallizations.

Still according to the invention, the metallizations of a same intermediate layer may be short-circuited to each other.

Furthermore according to the invention, said support means defining the cavities of a same level may comprise an ordered arrangement of columns.

Always according to the invention, the ordered arrangement of columns may be the same for each one of said n levels.

Still according to the invention, the ordered arrangement of columns may be arranged according to a square grid, whereby each cavity is defined by four columns.

Furthermore according to the invention, for each level not adjacent to the substrate, each column may be placed in correspondence with the center of a square defined by four columns of the adjacent level that is closest to the substrate.

Always according to the invention, all said m intermediate layers may have substantially the same thickness, and all said n levels may have substantially the same thickness, whereby all the cavities have the same height.

Still according to the invention, the external layer may have thickness larger than the thicknesses of each one of said m intermediate layers.

Furthermore according to the invention, said electrode means of the substrate, of said m intermediate layers, and of the external layer may be covered, in correspondence with the adjacent cavities, by a respective protective layer of insulating material.

Always according to the invention, the transducer may comprise means capable to connect at least part of said electrode means of the substrate, of said m intermediate layers, and of the external layer in parallel and/or in series to each other.

Still according to the invention, said means capable to connect at least part of said electrode means in parallel and/or in series to each other may be at least partially controlled by an external electronic unit.

Furthermore according to the invention, the transducer may be manufactured through a silicon micromachining process.

In particular, the transducer according to the invention allows to reduce the distance between electrodes (of the substrate, of the external plate, and of the interface intermediate layers between levels), consequently increasing the transmission and reception transduction efficiency, but without limiting the maximum transmitted pressure.

Moreover, the transducer according to the invention allows to decrease the compliance of the single levels (namely, of the single vibrating layers—either the external plate or intermediate layer(s) between levels), keeping such a total mechanical impedance, as seen from the radiating surface, as to have a wide bandwidth. In this way, the transmission and reception transduction efficiency is increased by means of the increase of the maximum applicable biasing dc voltage, however without decreasing the bandwidth.

Still, the transducer according to the invention allows to stiffen the radiation surface so as to have a radiating surface wherein all the points move with the same amplitude and phase, carrying out a piston motion of the radiating surface without reducing the bandwidth.

Furthermore, the transducer according to the invention is extremely versatile, since it offers the possibility to make the connection among the various structure electrodes in several ways, in order to apply and/or draw electrical signals in several ways so as to favor the open loop or short-circuit transmission and/or reception transduction efficiencies. In particular, the presence of many electrodes also offers the possibility to discriminate in frequency or to mechanically and electrically filter the received signals by exploiting the higher vibration modes of the multi-level structure, thus resulting advantageous in carrying out the so called "harmonic imaging".

BRIEF DESCRIPTION OF THE DRAWINGS

The present invention will be now described, by way of illustration and not by way of limitation, according to its preferred embodiments, by particularly referring to the Figures of the enclosed drawings, in which.

DETAILED DESCRIPTION

In the following of the description same references will be used to indicate alike elements in the Figures.

Figure 2:
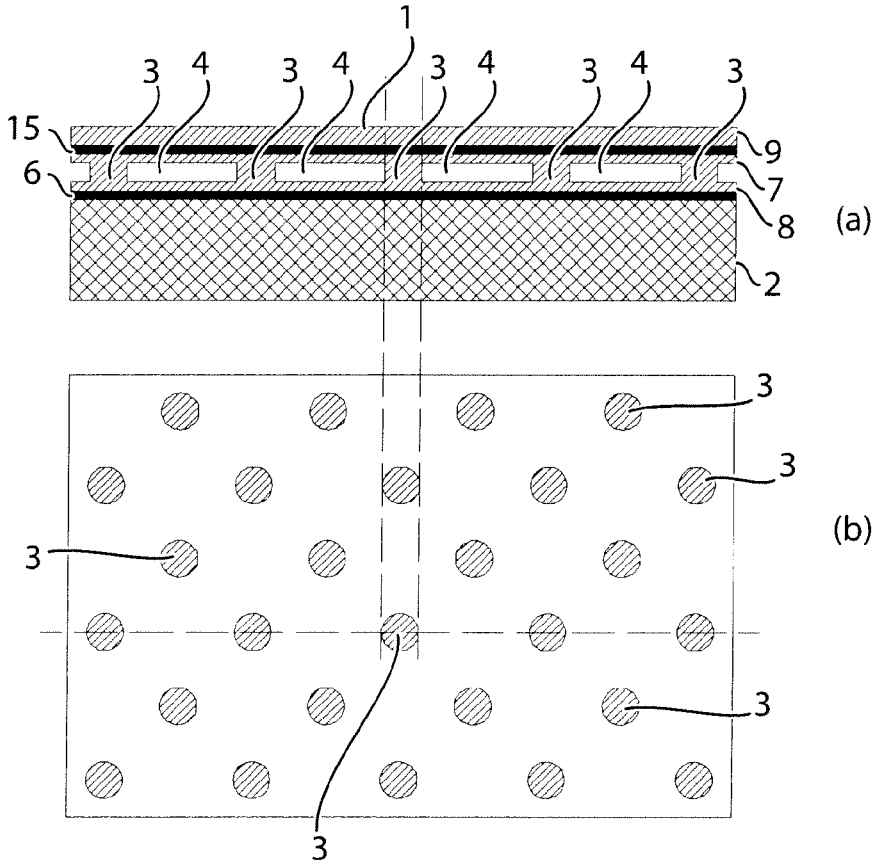
FIGS. 2*a* and 2*b* respectively show a sectional view and a plan view of a conventional ultrasonic capacitive transducer.

The inventors have developed a capacitive ultrasonic transducer having a multi-level structure, i.e. where, above the one-level structure of FIG. 2, other identical one-level structures are built which are spatially suitably positioned. In particular, in case of square grid of columns, each one-level structure may advantageously have each column positioned at the center of four corresponding columns of the one-level structure below. In this way it is possible to build a multi-level structure with any number of levels.

Figure 3:
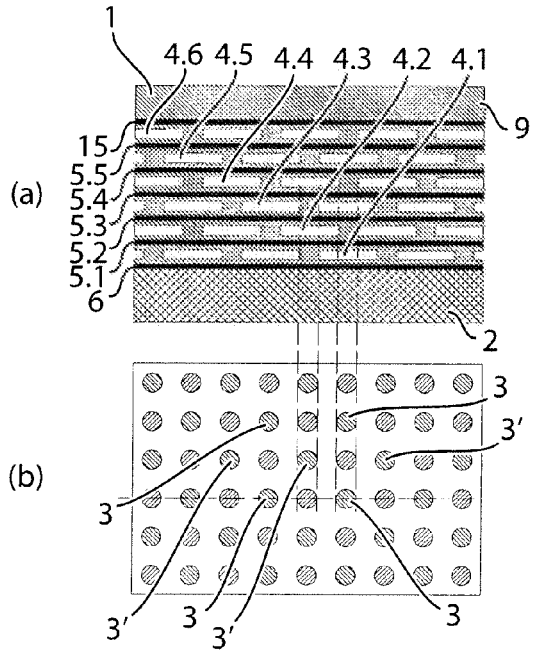
FIGS. 3*a* and 3*b* respectively show a sectional view and a plan view of a first multi-level capacitive ultrasonic transducer according to the invention according to the invention.
Figure 4:
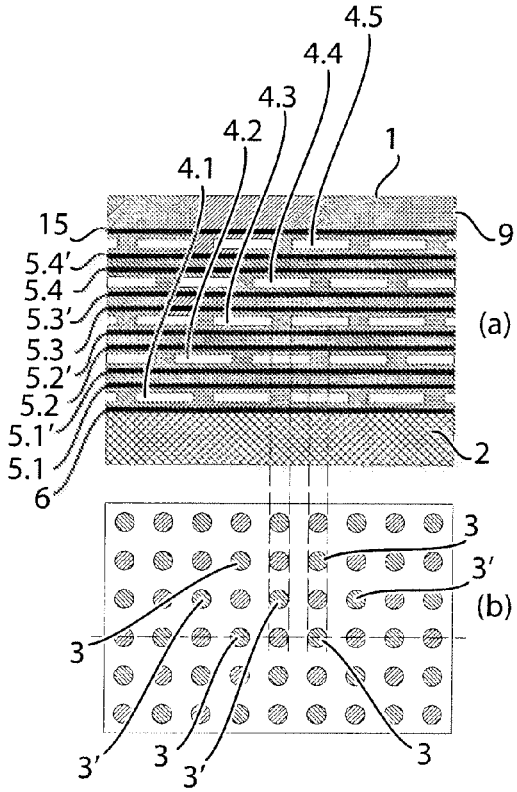
FIGS. 4*a* and 4*b* respectively show a sectional view and a plan view of a second multi-level capacitive ultrasonic transducer according to the invention.

FIGS. 3 and 4 show two multi-level transducers according to the invention having structures with six and five levels, respectively. Besides the substrate 2, provided with an electrode 6, and the layer 9, making the plate 1 in contact with the propagation means of the acoustic waves, provided with an electrode 15, such structures comprise six and five levels, respectively, comprising pluralities of cavities. Such cavities are defined by the faced surfaces of adjacent interface intermediate layers among levels (respectively five and four layers for FIGS. 3 and 4), in combination, in case of first and last level, with the upper surface of the substrate 2 and with the lower surface of the plate 1, respectively, and in combination with support columns 3.

Each interface intermediate layer among levels is provided with a respective electrode of the capacitive transducer, made through one or more metallizations. In this way, as in the case of the one-level structure of FIG. 2, the cavities of each level (indicated by the reference numbers 4.1, 4.2, 4.3, 4.4, 4.5, and 4.6, wherein cui the suffix indicates the level to which the cavity belongs) are interposed between the electrodes of each level.

In this regard, the transducer of FIG. 3 comprises only one metallization for each electrode of the five interface intermediate layers among the six levels (metallizations indicated by the reference numbers 5.1, 5.2, 5.3, 5.4, and 5.5), besides the metallizations of the electrode 6 of the substrate 2 and of the electrode 15 of the plate 1.

Instead, the transducer of FIG. 4 comprises, besides the single metallizations of the electrode 6 of the substrate 2 and of the electrode 15 of the plate 1, two metallizations for each electrode of the four interface intermediate layers among the five levels (metallizations indicated by the reference numbers 5.1 and 5.1', 5.2 and 5.2', 5.3 and 5.3', 5.4 and 5.4'). The two metallizations of the interface intermediate layers among the levels are electrically connected to each other and each one of them is positioned as close as possible to the cavity (4.1, 4.2, 4.3, 4.4, and 4.5) adjacent thereto. The two metallizations of the interface intermediate layers among the levels of the transducer of FIG. 4 allows the thickness of each intermediate layer to be adjusted without increasing the parasitic series capacitance. In fact, an increase of the thickness of the single intermediate layer would cause, in case of only one electrode per intermediate layer, the increase of the parasitic series capacitance, due to a higher thickness of dielectric material between two consecutive electrodes.

The last layer 9 of material serves to stiffen the transducer radiating surface 1 (actuated by the flexural capacitive structure) so that all the points of the same surface move with the same amplitude and phase, carrying out a piston motion.

In the following, the operation principles of the multi-level structure of the transducer according to the invention will be shown through considerations of analytical type and finite element simulations.

Figure 5:
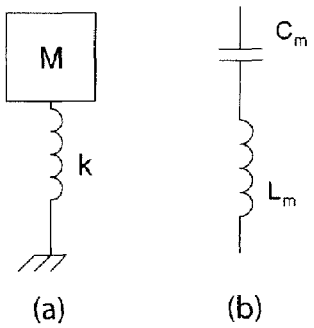
FIGS. 5*a* and 5*b* respectively show the lumped parameter mechanical model and its electrical equivalent circuit of a conventional ultrasonic capacitive transducer.

FIG. 5 shows the simple mass-spring lumped parameter model, and its electrical equivalent circuit $C_m$-$L_m$, with which, as said before, a one-level transducer, based on a vibrating flexural structure at frequencies close to resonance, may be modelled to a first approximation. The resonance frequency and the mechanical impedance determine the frequency operation characteristics (band center and bandwidth). The formulas for calculating such quantities for a one-level transducer are, respectively:

$$\omega_{ris}^{(1)} = \frac{1}{\sqrt{L_m C_m}}, \text{ and} \quad [10]$$

$$Z_m^{(1)} = j\omega L_m + \frac{1}{j\omega C_m}. \quad [11]$$

Figure 6:
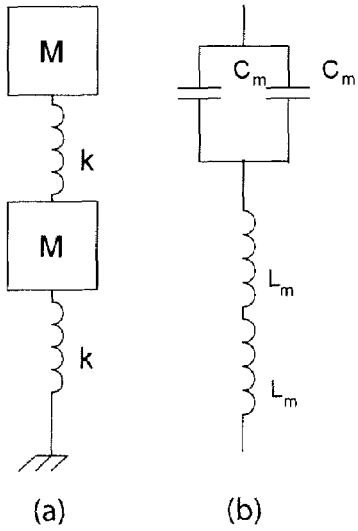
FIGS. 6*a* and 6*b* respectively show the lumped parameter mechanical model and its electrical equivalent circuit of a third multi-level capacitive ultrasonic transducer according to the invention.

If an identical oscillator is mechanically series connected to the oscillator of FIG. 5, as shown in FIG. 6, lumped parameter model in the case of a two-level structure is obtained. In this case, the total compliance $C_{m_tot}$ and the total mass $L_{m_tot}$ are doubled ($C_{m_tot}=2C_m$; $L_{m_tot}=2L_m$) while the resonance frequency (of the natural vibration first mode) is halved. The resonance frequency and the mechanical impedance are given, respectively, by the following formulas:

$$\omega_{ris}^{(2)} = \frac{1}{\sqrt{2^2 L_m C_m}} = \frac{1}{2\cdot\sqrt{L_m C_m}} = \frac{\omega_{ris}^{(1)}}{2}, \text{ and} \quad [12]$$

$$Z_m^{(2)} = j\omega 2L_m + \frac{1}{j\omega 2C_m}. \quad [13]$$

In general, for n series oscillators, i.e. for a n-level structure, it is:

$$\omega_{ris}^{(n)} = \frac{1}{\sqrt{n^2 L_m C_m}} = \frac{1}{n\cdot\sqrt{L_m C_m}} = \frac{\omega_{ris}^{(1)}}{n}, \text{ and} \quad [14]$$

$$Z_m^{(n)} = j\omega n L_m + \frac{1}{j\omega n C_m}. \quad [15]$$

Figure 7:
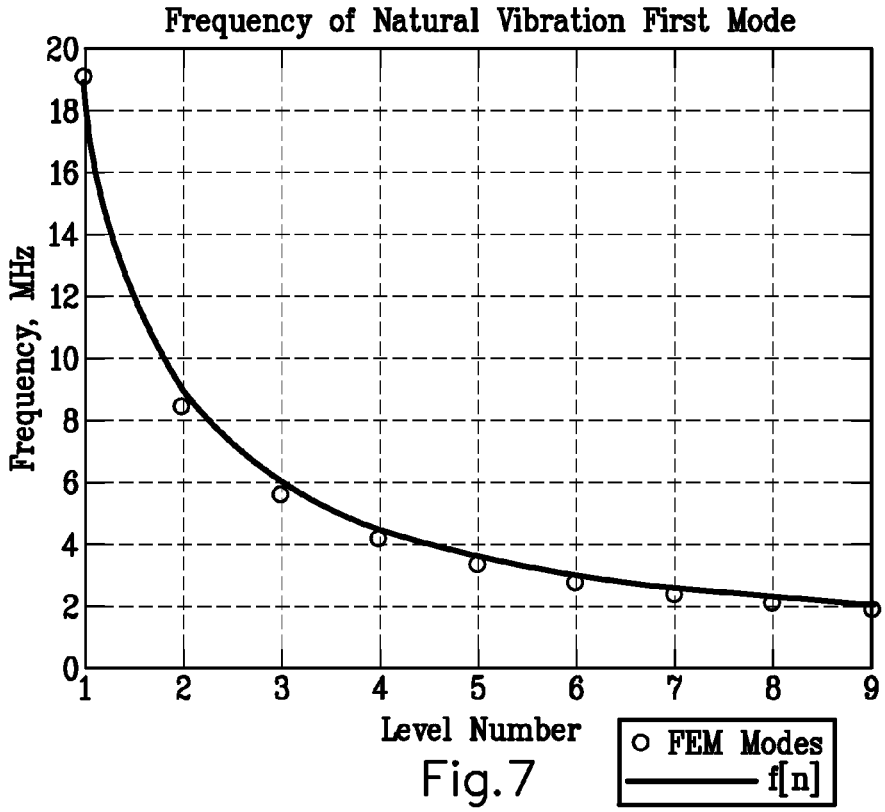
FIG. 7 shows the behaviours of the frequency $f_{ris}$ of the natural vibration first mode of a transducer according to the invention under the variation of the level number n, obtained through finite element simulations and analytical calculation.

FIG. 7 shows the behaviour of the frequency $f_{ris}$ of the natural vibration first mode of a multi-level structure when the level number n varies, obtained through finite element analysis (FEA), and the behaviour of the analytical curve $$f_{ris}^{(n)} = \frac{1}{n\cdot 2\pi\cdot\sqrt{L_m C_m}} = \frac{f_{ris}^{(1)}}{n}. \quad [16]$$

Hence, a n-level structure having total compliance $C_m$ and total mass $L_m$, and hence the same frequency characteristics of the single level structure (band center and bandwidth), is formed by n levels singly having compliance $C_m$ and mass $L_m$, which are lower by n times:

$$C'_m = \frac{C_m}{n}, \text{ and} \quad [17]$$

$$L'_m = \frac{L_m}{n}. \quad [18]$$

Now, considering a n-level transducer, the maximum (collapse) dc voltage applicable to the single level only depends on the compliance $C_m'$ of the single level. Recalling the formulas [4] and [5], it is increased by a factor equal to $\sqrt{n}$, with a consequent increase of the transformation factor $\phi$ by an identical factor $\sqrt{n}$:

$$V'_{col} = \alpha \cdot \sqrt{\frac{n d_{gap}^3}{C_m \varepsilon_0}}, \text{ and} \quad [19]$$

$$\phi'_{\max} = \alpha \cdot S \cdot \sqrt{\frac{n \varepsilon_0}{C_m d_{gap}}}. \quad [20]$$

The increase of the maximum transformation factor $\phi$ causes, depending on the type of connection made between the electrodes of the single levels, the increase of the transmission or reception (open circuit or short-circuit) transduction sensitivity.

Figure 8:
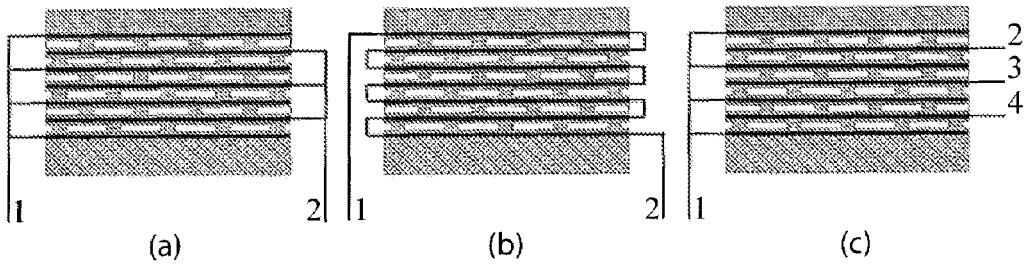
FIG. 8 shows three configurations of connection of the electrodes of a fourth multi-level capacitive ultrasonic transducer according to the invention.

The presence of a number of electrodes larger than two offers the possibility of making their connection according to different manners, as shown in FIG. 8, wherein three different connection configurations of a multi-level transducer according to the invention comprising six levels are represented: FIG. 8*a* shows a parallel connection configuration; FIG. 8*b* shows a series connection configuration; FIG. 8*c* shows a frequency discrimination connection configuration.

In the following, a comparison is illustrated among the transmission and reception sensitivities of a one-level structure, such as that shown in FIG. 2, and of a two-level one (having two metallizations 5.1 and 5.1' for the electrode of the interface intermediate layer), shown in FIG. 9, in the first two configurations of connection of the electrodes, i.e. in parallel and in series. Sensitivities calculation has been made through a finite element analysis. In particular, the two structures have been sized so as to have the same frequency behaviour (same resonance frequency $f_{ris}$ and same specific mechanical impedance behaviour $Z_m$). All cases have been analyzed even making use of the lumped parameter equivalent circuit model.

Figure 10:
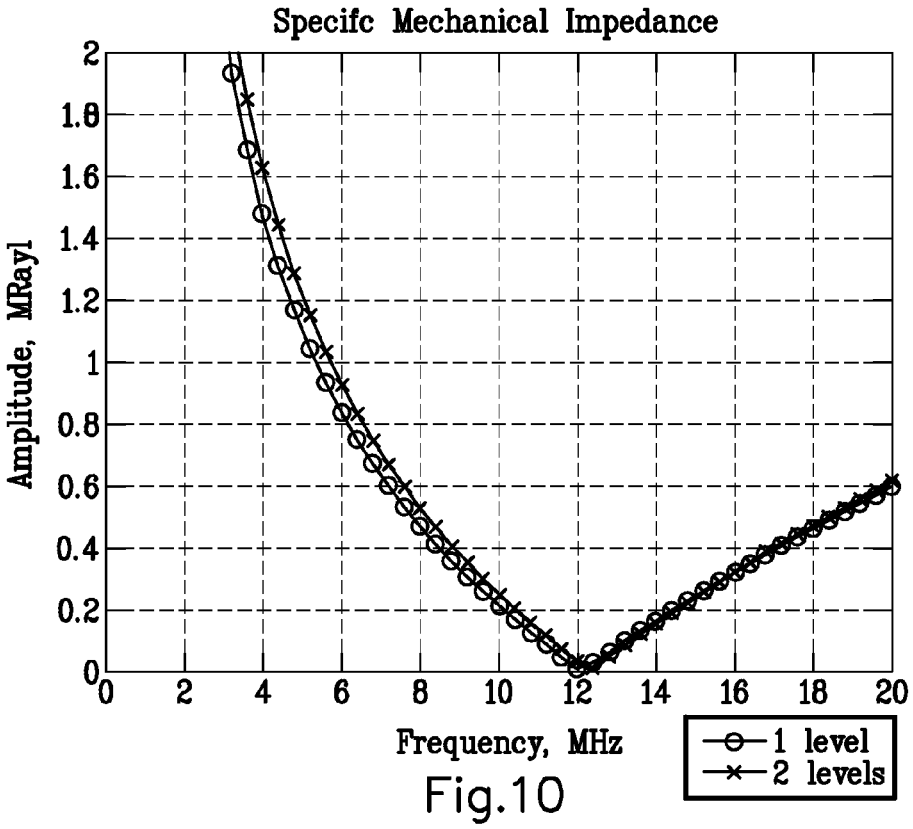
FIG. 10 shows the behaviours of the module of the specific mechanical impedance for the transducers of FIGS. 2 and 9.

In FIG. 10, the specific mechanical impedance module behaviours for the two modelled structures are shown.

An electrostatic-structural finite element analysis has allowed to determine the collapse voltage $V_{col}$ for these two structures, considering that the electrodes of the two-level structure have been connected in parallel (similarly to what shown in FIG. 8*a*). Collapse voltages calculated for the one-level and two-level structures are respectively 50V and 70V. In dynamic simulations the applied dc voltages are equal to 80% of the respective collapse voltages.

Figure 1:
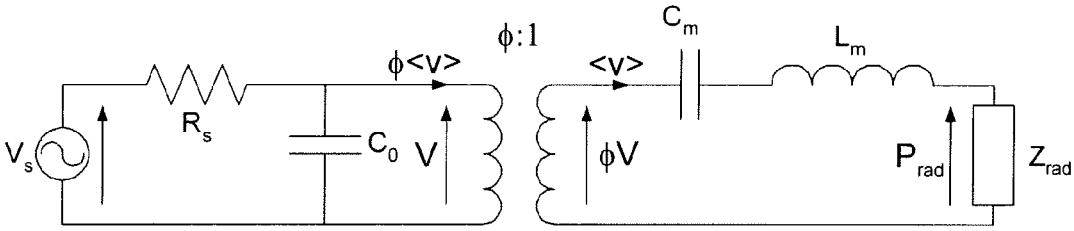
FIG. 1 shows the lumped parameter equivalent circuit of a conventional electromechanical transducer.

Making again reference to FIG. 1, showing the transmission equivalent circuit for the one-level structure, the transmission sensitivity $S_t(\omega)$ mainly depends on the mechanical parameters (loop at the secondary) and on the transformation factor $\phi$:

$$S_1(\omega) = \frac{\phi}{S_a} \frac{Z_r}{Z_m + Z_r} \quad [21]$$

where $S_a$ is the area of the electrically active surface of the transducer and $Z_r$ is the impedance $Z_{rad}$ of FIG. 1.

Figure 11:
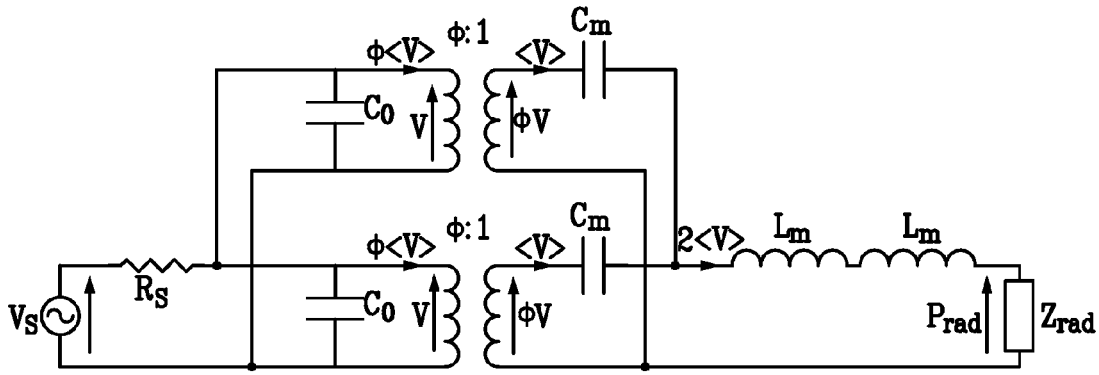
FIG. 11 shows the lumped parameter equivalent circuit of the transducer of FIG. 9, in transmission, in the first configuration of electrode connection.

FIG. 11 shows the lumped parameter equivalent circuit of the two-level transducer, wherein the fact that the electrodes are connected in parallel (similarly to what shown in FIG. 8*a*) is pointed out. The transmission sensitivity is higher than the one-level case because of the larger transformation factor. The model points out the fact that the velocities v, at the secondary, adds up in the output loop. This indicates that the movement of the surface 1 of the transducer of FIG. 9 in contact with the propagation means is given by the sum of the movements of the single levels (i.e., the surface 1 and the intermediate layer between the two levels of the transducer).

Figure 12:
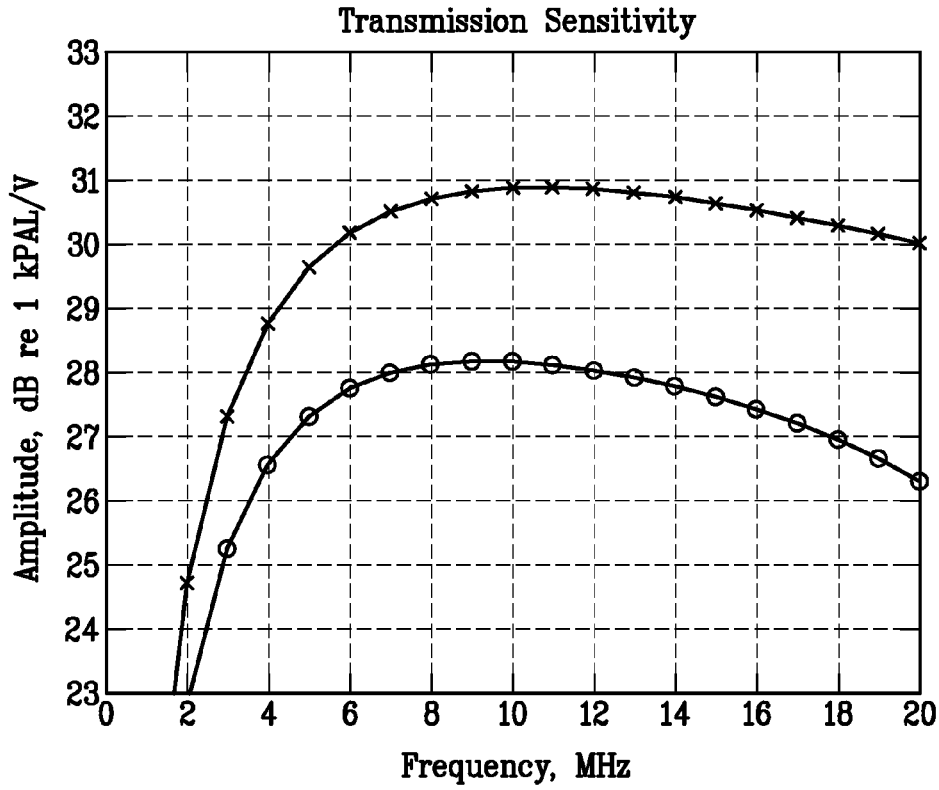
FIG. 12 shows the graphs of the transmission sensitivity, obtained through finite element simulations, of the transducers of FIGS. 2 and 9 in the first configuration of electrode connection.

FIG. 12 shows the sensitivity graphs of the two cases obtained through an electro-mechanical-acoustic finite element analysis that takes account of the fact that the structure is a distributed parameter one, and only to a first approximation it may be represented with a lumped parameter equivalent circuit. It should be noted that, with the two-level structure, about 3 dB are gained, in transmission, only due to the fact that the transformation factor has been increased.

Figure 13:
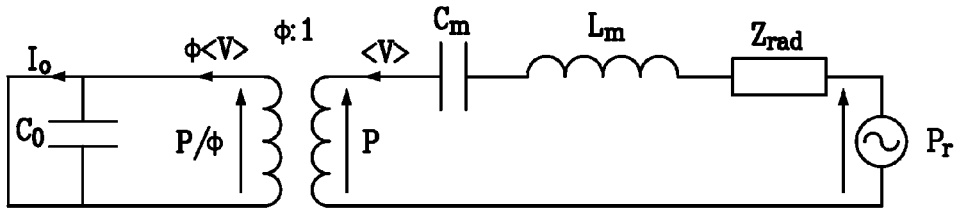
FIG. 13 shows the reception lumped parameter equivalent circuit of the transducer of FIG. 2 in the first configuration of electrode connection.

In the case when the multi-level electrodes are connected in parallel, the detection method that allows to gain sensitivity even in reception is the short-circuited one (current detection). In FIG. 13 the short-circuited reception equivalent circuit for the one-level structure, the reception sensitivity of which $S_r^l(\omega)$ is given by:

$$S_r^l(\omega) = \phi \frac{1}{Z_m + Z_r} \quad [22]$$

where $Z_r$ is the impedance $Z_{rad}$ of FIG. 13.

Figure 14:
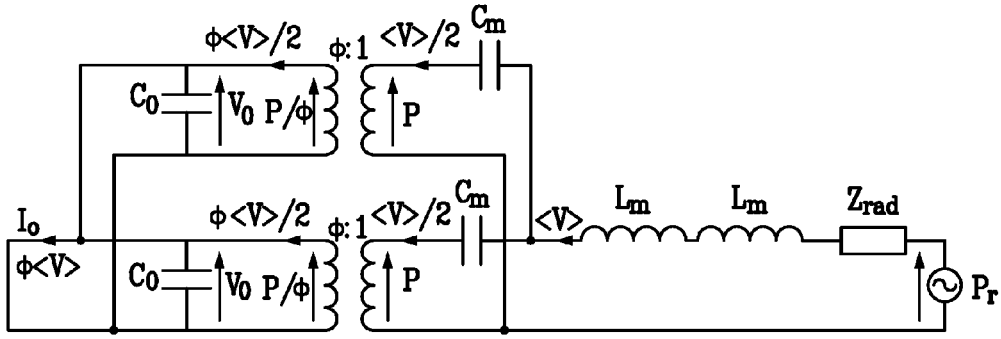
FIG. 14 shows the reception lumped parameter equivalent circuit of the transducer of FIG. 9 in the first configuration of electrode connection.

With reference to FIG. 14, it is observed that, given a pressure incident on the face of the two-level transducer with electrodes connected in parallel, the velocity v of the same surface 1 distributes over the various levels, in this case halving. The velocities are converted in currents by means of the transformer and, thanks to the parallel connection of the electrodes, they add resulting in an output current proportional, by means of the transformation factor, to the velocity of the surface 1 faced to the fluid.

Figure 15:
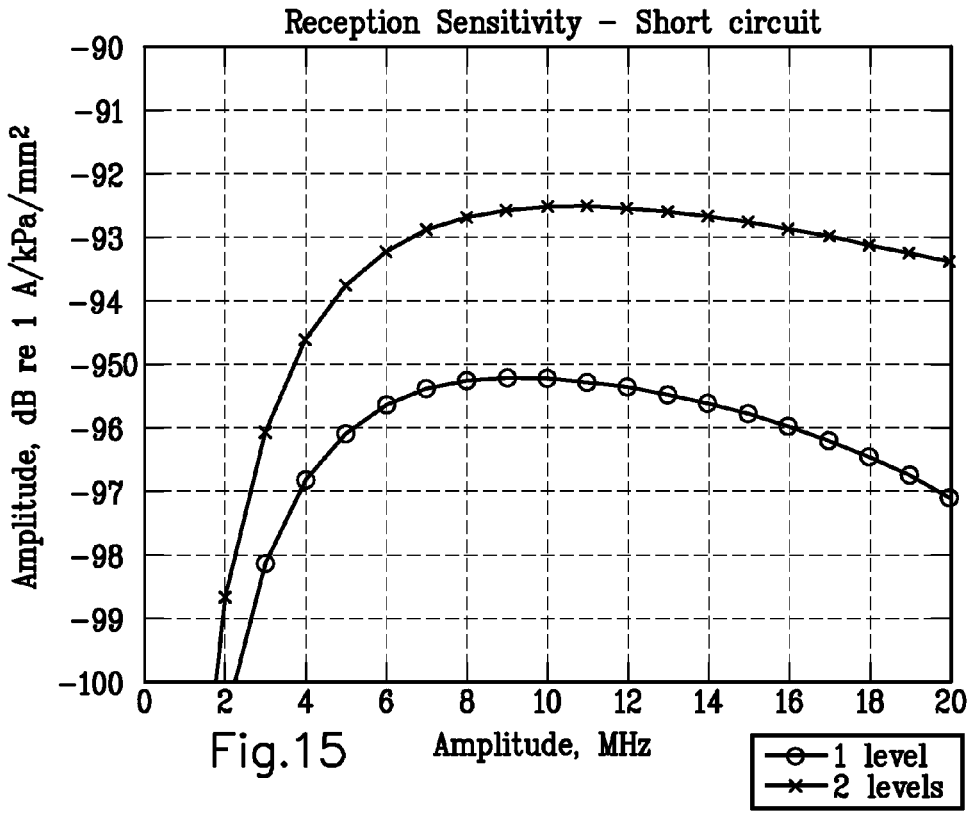
FIG. 15 shows the graphs of the reception sensitivity, obtained through finite element simulations, of the transducers of FIGS. 2 and 9 in the first configuration of electrode connection.

Even in this case, as also shown by the finite element simulation results illustrated in FIG. 15, the short-circuit reception sensitivity behaviour of the two-level structure is higher by about 3 dB with respect to the one-level structure. In particular, in FIG. 15 the reception sensitivity has been normalized with respect to the radiating surface, whereby sensitivity values are expressed per surface unit.

Figure 16:
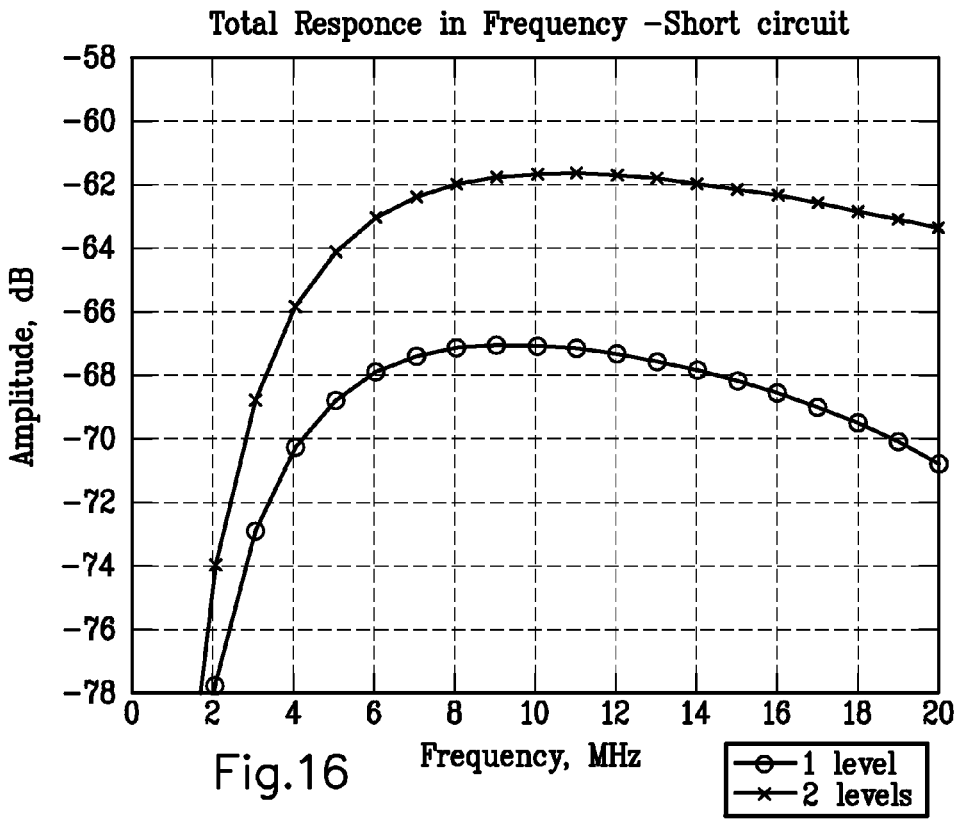
FIG. 16 shows the behaviours of the frequency total responses, obtained through finite element simulations, of the transducers of FIGS. 2 and 9 in the first configuration of electrode connection.

FIG. 16 shows the graph of the total response in frequency (equal to the product of the transmission and reception sensitivities). It should be noted that the total gain is 6 dB. Even in this case, both the quantities have been normalized with respect to the radiating surface.

Hence, it is evident that, thanks to the increase of the transformation factor due to the increase of the collapse voltage, a n-level structure with electrodes connected in parallel has a total response in frequency that is n times larger with respect to a one-level structure, with comparable performance in frequency (same bandwidth).

By connecting the multi-level structure electrodes differently from the parallel connection it is possible to improve some transducer characteristics.

In particular, by making a series connection of the electrodes in reception, as shown in FIG. 8*b*, the open loop reception sensitivity may be increased.

Figure 17:
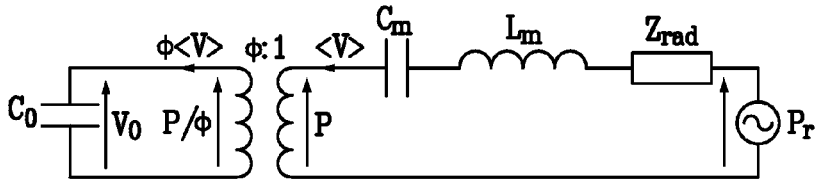
FIG. 17 shows the reception lumped parameter equivalent circuit of the transducer of FIG. 2 in a second configuration of connection of the electrodes.

FIG. 17 shows the open loop reception equivalent circuit of a one-level structure, the reception sensitivity $S_r^V(\omega)$ of which is given by:

$$S_r^V(\omega) = \phi \frac{Z_{eb}}{Z_m + Z_r + \frac{\phi^2}{S_a} Z_{eb}} \quad [23]$$

where $Z_{eb}$ is the locked electrical impedance (i.e. the impedance due to the value of the capacitance of the transducer to which only the biasing voltage is applied) and $S_a$ is still the electrically active surface area of the transducer.

Figure 9:
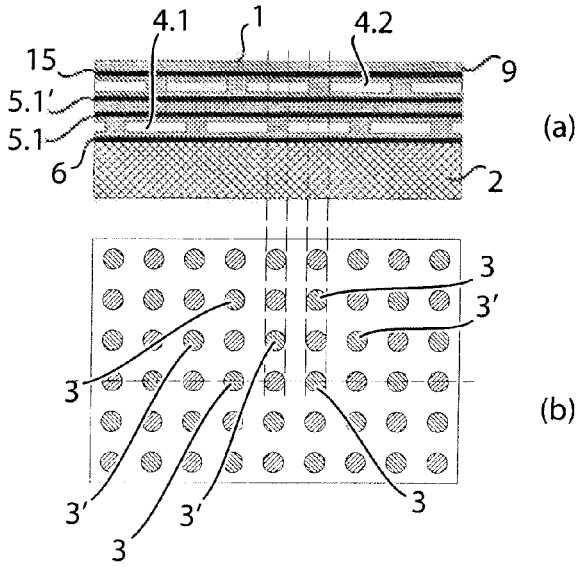
FIGS. 9*a* and 9*b* respectively show a sectional view and a plan view of a fifth multi-level capacitive ultrasonic transducer according to the invention.
Figure 18:
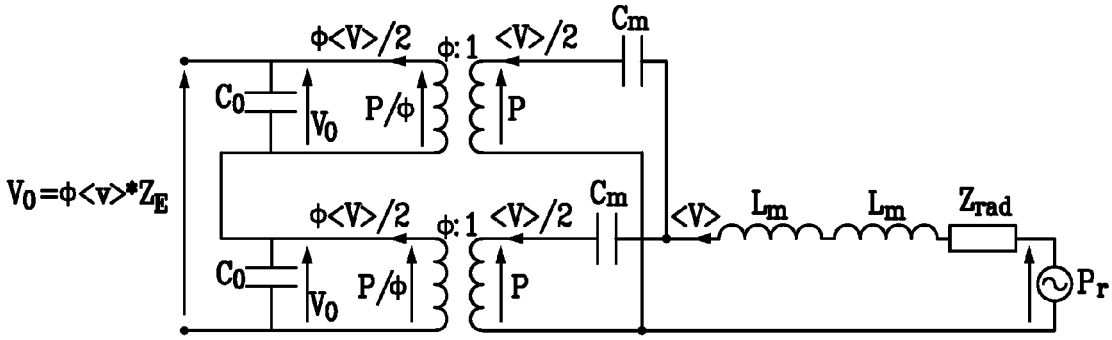
FIG. 18 shows the reception lumped parameter equivalent circuit of the transducer of FIG. 9 in the second configuration of electrode connection.

FIG. 18 shows the reception equivalent circuit of the two-level transducer of FIG. 9 wherein the electrodes are connected in series, similarly to what shown in FIG. 8*b* (in particular, in FIG. 18 the transducer electrical impedance $Z_E$ is mentioned). Voltages produced under reception are proportional to the movement. Since the electrodes are connected in series, voltages add (similarly to what occurs for currents in case of short-circuit reception). Hence even in this case there is an improvement of the reception sensitivity due to the larger transformation factor (equal to 3 dB).

As said before, the transducer according to the invention also offers the possibility to make the connection among the various structure electrodes so as to discriminate the received signals in frequency, exploiting the higher vibration modes of the multi-level structure.

The first two longitudinal vibration modes of a multi-level structure with a number of levels larger than one are at frequencies $f_1$ and $f_2$ the ratio $f_2/f_1$ of which is equal to three; in this regard, the first two longitudinal vibration modes are those wherein all the points of a single vibrating layer (either the external plate or an intermediate layer between levels) move with the same phase. In FIG. 8*c* the case of a six-level structure is shown.

Figure 19:
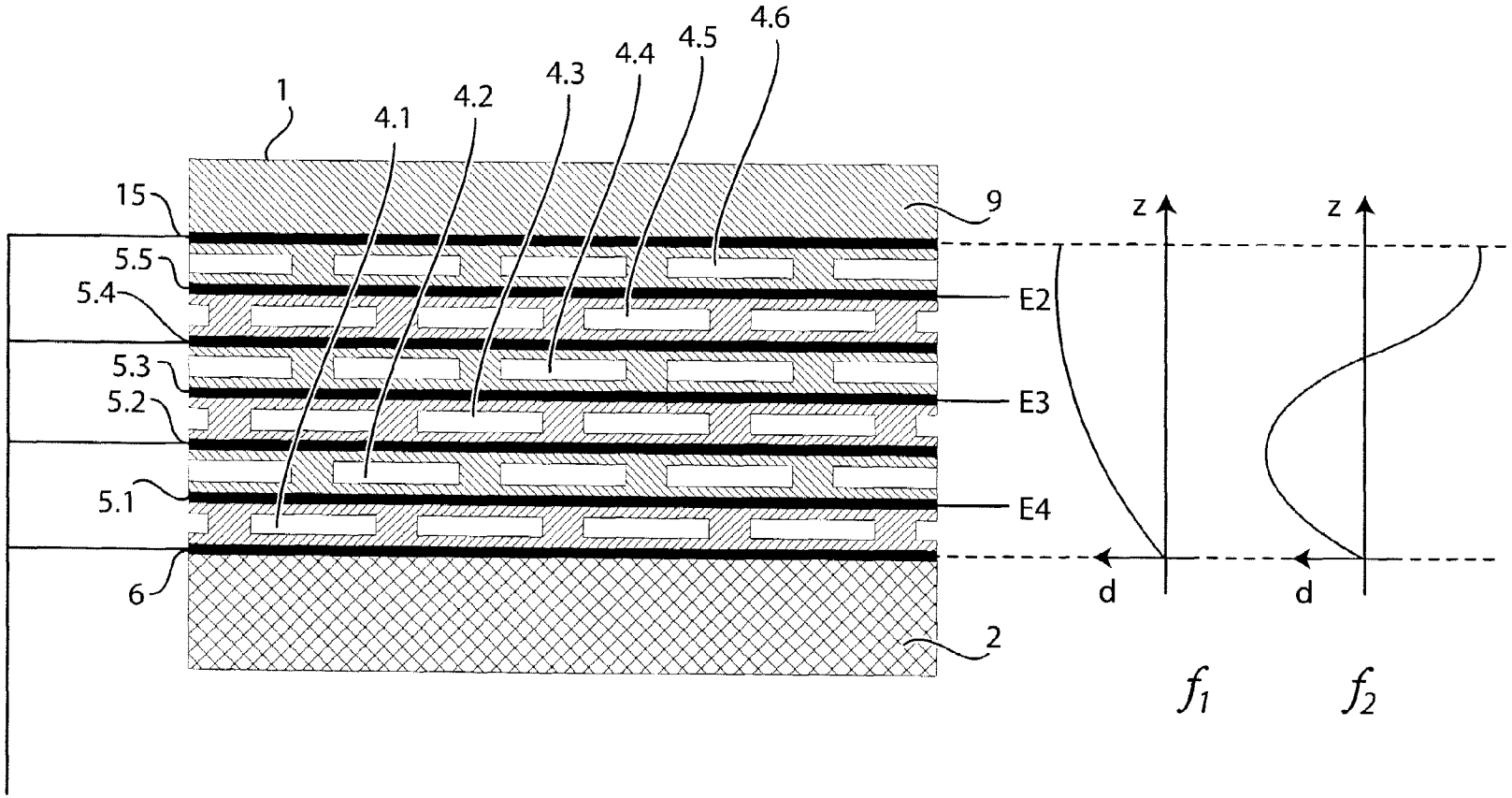
FIG. 19 schematizes the reception frequency behaviour of the transducer of FIG. 8*c*.

As shown in FIG. 19, at frequencies close to the first mode one ($f_1$), all the intermediate layers between levels and the external plate 1 of the structure move with the same phase. In other words, movement u of the structure vibrating layers has, along time, the same sign with respect to the movement direction z. Consequently, all the cavities (also called air-gaps, indicated in FIG. 19 with reference numbers 4.1, 4.2, 4.3, 4.4, 4.5, 4.6) simultaneously expand and contract.

Instead, at frequencies close to the second mode one ($f_2$), some structure vibrating layers move with opposite phase. In other words, while some cavities expand, others contract. These modes are equivalent to the so-called thickness modes of an elastic bulk having one face free to move and another one that is rigidly constrained (for which modes frequencies of the modes are actually odd multiples of the fundamental frequency).

An example of how this characteristic may be exploited is that of transmission and reception over distinct frequency bands. To this end, in the case of the transducer of FIGS. 8*c* and 19, the electrode 6 of the substrate 2, the electrode 15 of the external plate 1, and the electrodes 5.2 and 5.4 of the intermediate layers are connected in parallel to each other (through a connection E1), while the electrodes 5.1, 5.3 and 5.5 of the other intermediate layers are electrically separated from the others (and accessible through three respective connections E2, E3, and E4). Thanks to this electrode configuration, it is possible to amplify the device response around the first or second mode frequencies, by detecting the sum or the difference of the electrical signals present at the electrodes E3 and E4. There could be hence a specific use for the so-called harmonic imaging wherein transmission is at a frequency and reception is at a double or triple frequency.

Figure 20:
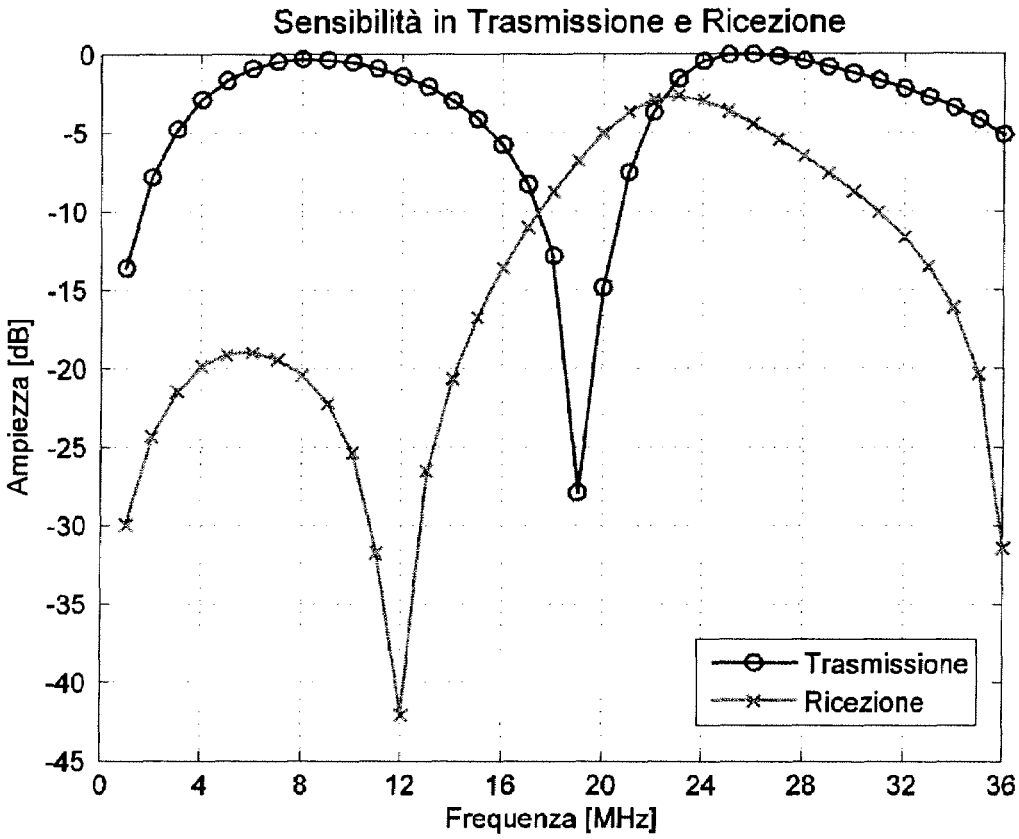
FIG. 20 shows the transmission and reception transfer functions, obtained through finite element simulations, of the transducers of FIG. 8*c*.

FIG. 20 shows the results of a finite element simulation wherein transmission and reception transfer functions of the structure of FIGS. 8*c* and 19 are compared. Reception graph has been obtained by making the subtraction of the electrical signals related to the electrodes E3 and E4; in particular, the reception has been carried out by short circuiting such electrodes and hence evaluating the difference between currents. From the reception graph it is evident that lower frequencies are rejected. It is hence possible, with a transducer of the present type, to transmit at a frequency and to selectively receive with bands centered at double or triple frequency, as required by harmonic imaging applications for medical diagnostics.

The transducer according to the invention may be advantageously manufactured by adapting any one of the silicon micromachining processes presently applied for the manufacture of transducers having one-level structure, e.g. by simply repeating the steps of such processes related to making one level provided with cavities by a number of times equal to the number of levels of the transducer according to the invention.

The advantages obtainable through the transducer according to the invention with respect to conventional capacitive transducers are evident.

First of all, as said before, it allows to reduce the distance between electrodes, consequently increasing transmission and reception transduction efficiency, without limiting the maximum transmitted pressure. In fact, the maximum electrostatic pressure applicable to the electrode is inversely proportional to the distance between electrodes. On the contrary, movement of the membrane is proportional to the transmitted pressure. In the multi-level structure it is possible to reduce the distance between electrodes because the movement of the radiating surface is "distributed" among the various vibrating layers. In other words it is the sum of the single relative movements among the electrodes of the single vibrating layers. Hence, under equal desired movement of the radiating surface, it is possible to reduce the distances between electrodes by a factor equal to the number of levels, with a consequent increase of the transmission and reception transduction efficiency.

Moreover, the transducer according to the invention allows to reduce the compliance of the single vibrating layers, keeping such a total mechanical impedance, as seen from the radiating surface, as to have a wide bandwidth. In fact, a multi-level structure formed by the combination of a certain number of vibrating layers each having a certain mechanical impedance has as a whole a mechanical impedance diminished by a factor equal to the number of levels. Collapse voltage depends on the compliance of the single vibrating layer. It is hence possible to increase the collapse voltage by decreasing the compliance of the single vibrating layers. In this way, the transmission and reception transduction efficiency is increased by means of the increase of the maximum applicable biasing dc voltage, however keeping an adequate whole mechanical impedance, without decreasing the bandwidth.

Still, the transducer according to the invention allows to stiffen the radiation surface so as to have a radiating surface wherein all the points move with the same amplitude and phase. In fact, structure elasticity is provided by the flexibility of the single vibrating layers. It is not necessary, as in the one-level case, to put a flexurally vibrating surface that faces the propagation means: a radiating structure that flexurally vibrates "sees" a complex radiation impedance, and this entails a reduction of the bandwidth. Instead, in the multi-level case, it is possible to reduce the reactive part of the radiation impedance by stiffening the layer on which the radiating surface is. In the examples of FIGS. 3 and 4 the radiating plate is stiffen through an increase of the thickness of the layer 9 of the external plate 1.

Finally, the transducer according to the invention is extremely versatile, since it offers the possibility to make the connection among the various structure electrodes in several ways, in order to apply and/or draw electrical signals in several ways so as to favor the open loop or short-circuit transmission and/or reception transduction efficiencies. Advantageously, this may be made by an external electronic unit controlling the electrical connections of the transducer electrodes. In particular, the presence of many electrodes also offers the possibility to discriminate in frequency or to mechanically and electrically filter the received signals by exploiting the higher vibration modes of the multi-level structure, thus resulting advantageous in carrying out the so called harmonic imaging.

The preferred embodiments have been above described and some modifications of this invention have been suggested, but it should be understood that those skilled in the art can make other variations and changes, without so departing from the related scope of protection, as defined by the following claims.

The invention claimed is:

1. A capacitive ultrasonic transducer, comprising an external layer operating as an external plate, provided with electrode means, capable to vibrate, and a stiff substrate, in turn provided with electrode means, said capacitive ultrasonic transducer further comprises n levels, with $n \geqq 2$, interposed between the plate and the substrate, each level including a plurality of cavities, and m interface intermediate layers, capable to vibrate, among said n levels, with $m=(n-1)$, the cavities of each one of said n levels being further defined by support means connected between faced surfaces of layers adjacent to said cavities, each one of said m intermediate layers being provided with electrode means, whereby the cavities of each level are interposed between a pair of electrode means belonging to either two adjacent intermediate layers or to an intermediate layer and to one out of the substrate and the plate.

2. A transducer according to claim 1, wherein said electrode means of each one of said m intermediate layers comprises one or more metallizations.

3. A transducer according to claim 2, wherein the metallizations of a same intermediate layer are short-circuited to each other.

4. A transducer according to claim 1, wherein said support means defining the cavities of a same level comprises an ordered arrangement of columns.

5. A transducer according to claim 4, wherein the ordered arrangement of columns is the same for each one of said n levels.

6. A transducer according to claim 4, wherein the ordered arrangement of columns is arranged according to a square grid, whereby each cavity is defined by four columns.

7. A transducer according to claim 6, wherein the ordered arrangement of columns is the same for each one of said n levels, and, for each level not adjacent to the substrate, each column is placed in correspondence with the center of a square defined by four columns of the adjacent level that is closest to the substrate.

8. A transducer according to claim 1, wherein all said m intermediate layers have substantially the same thickness, and all said n levels have substantially the same thickness, whereby all the cavities have the same height.

9. A transducer according to claim 1, wherein the external layer has thickness larger than the thicknesses of each one of said m intermediate layers.

10. A transducer according to claim 1, wherein said electrode means of the substrate, of said m intermediate layers, and of the external layer are covered, in correspondence with the adjacent cavities, by a respective protective layer of insulating material.

11. A transducer according to claim 1, further comprising means capable to connect at least part of said electrode means of the substrate, of said m intermediate layers, and of the external layer in parallel and/or in series to each other.

12. A transducer according to claim 11, wherein said means capable to connect at least part of said electrode means in parallel and/or in series to each other are at least partially controlled by an external electronic unit.

13. A transducer according to claim 1, wherein it is manufactured through a silicon micromachining process.

* * * * *